United States Patent [19]

Marks et al.

[11] Patent Number: 5,003,143

[45] Date of Patent: Mar. 26, 1991

[54] MICROWAVE SLUDGE DRYING APPARATUS AND METHOD

[75] Inventors: Daniel B. Marks, St. Charles; Donald G. Fluchel, St. Louis, both of Mo.

[73] Assignee: Progressive Recovery, Inc., Columbia, Ill.

[21] Appl. No.: 507,253

[22] Filed: Apr. 9, 1990

[51] Int. Cl.[5] ..... H05B 6/80

[52] U.S. Cl. ..... 219/10.55 M; 219/10.55A; 219/10.55 R; 34/1; 422/21; 422/285

[58] Field of Search ..... 219/10.55 R, 10.55 A, 219/10.55 E, 10.55 F, 10.55 M; 34/1, 4; 422/21, 22, 186, 285

[56] References Cited

U.S. PATENT DOCUMENTS

| | | | |
|---|---|---|---|
| 4,015,341 | 4/1977 | McKinney et al. | 34/4 |
| 4,045,638 | 8/1977 | Chiang et al. | 219/10.55 A |
| 4,045,639 | 8/1977 | Meisel | 219/10.55 A |
| 4,307,277 | 12/1981 | Maeda et al. | 219/10.55 R |
| 4,313,786 | 2/1982 | Smith | 219/10.55 M |
| 4,347,670 | 9/1982 | Wear et al. | 219/10.55 R |
| 4,364,859 | 12/1982 | Ohtsuka et al. | 219/10.55 M |
| 4,370,534 | 1/1983 | Brandon | 219/10.55 A |
| 4,459,763 | 7/1984 | Meissner et al. | 34/75 |
| 4,622,446 | 11/1986 | Sugisawa et al. | 219/10.55 R |
| 4,622,448 | 11/1986 | Awata et al. | 219/10.55 A |
| 4,640,020 | 2/1987 | Wear et al. | 219/10.55 R |
| 4,737,610 | 4/1988 | Kotsch et al. | 219/10.55 A |
| 4,778,970 | 10/1988 | Klaila | 219/10.55 A |
| 4,805,317 | 2/1989 | Inglis et al. | 34/1 |
| 4,822,966 | 4/1989 | Matsubara | 219/10.55 M |

*Primary Examiner*—Philip H. Leung

*Attorney, Agent, or Firm*—Rogers, Howell & Haferkamp

[57] ABSTRACT

An apparatus for separating hazardous volatile and semi-volatile organic materials from contaminated solid waste by-products is comprised of an evaporation/-vacuum heating chamber that is designed to hold a sample of the solid waste product on a batch basis, a microwave generator that subjects the sample of waste product to microwave energy, an electrical resistance type heating system that heats portions of the waste product sample adjacent the container holding the sample that are not subjected to the full strength of the microwaves, and an evacuation/condensing system that draws off volatile vapors distilled from the waste sample and condenses and collects the hazardous volatile organic materials, leaving a resultant waste product cake, dry and virtually free of volatile matter in the evaporation/vacuum heating chamber.

21 Claims, 2 Drawing Sheets

FIG. 1.
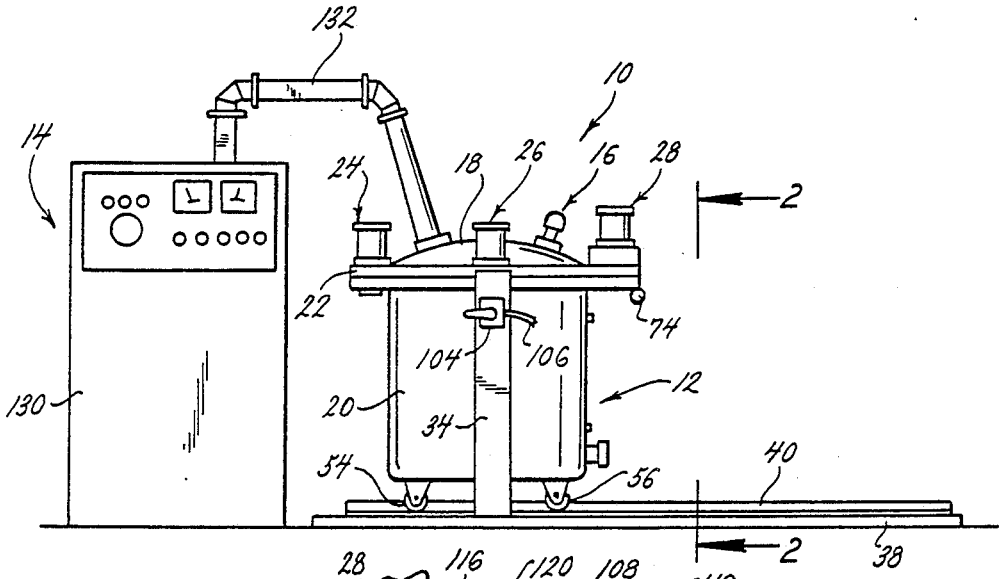
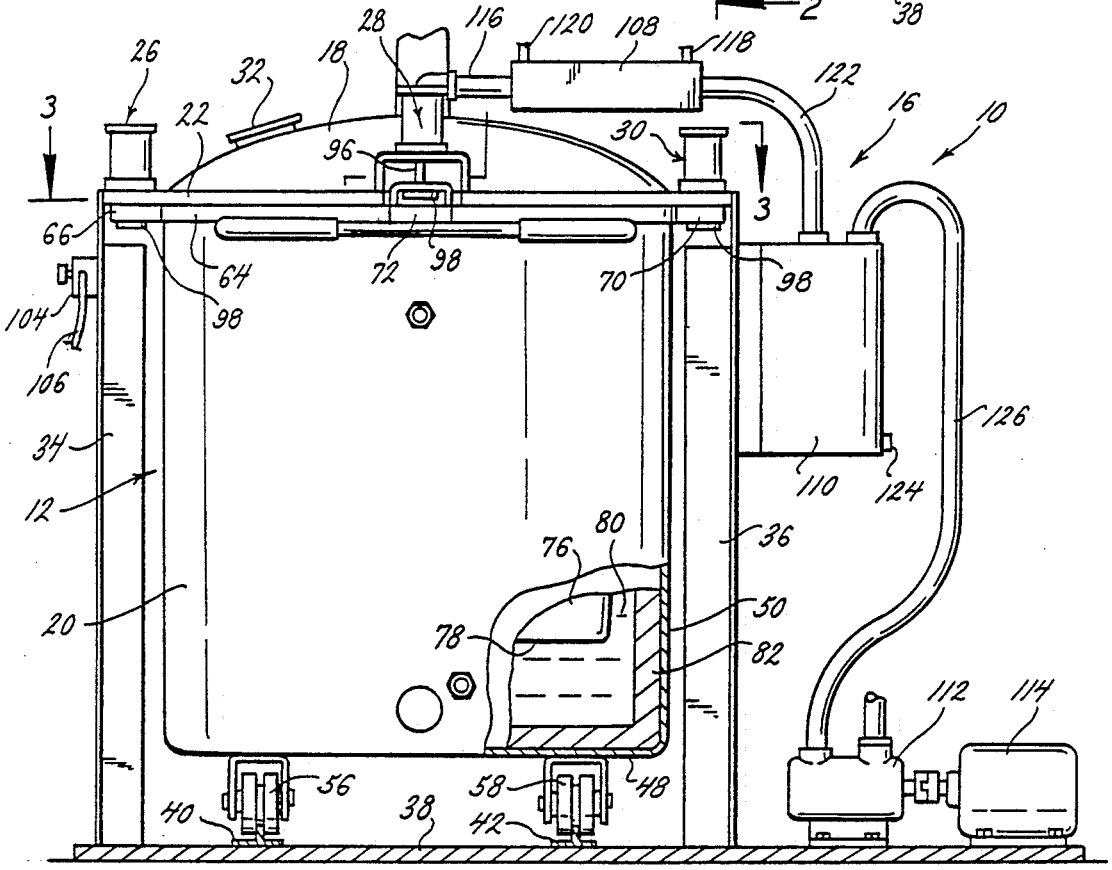
FIG. 2.

FIG. 3.
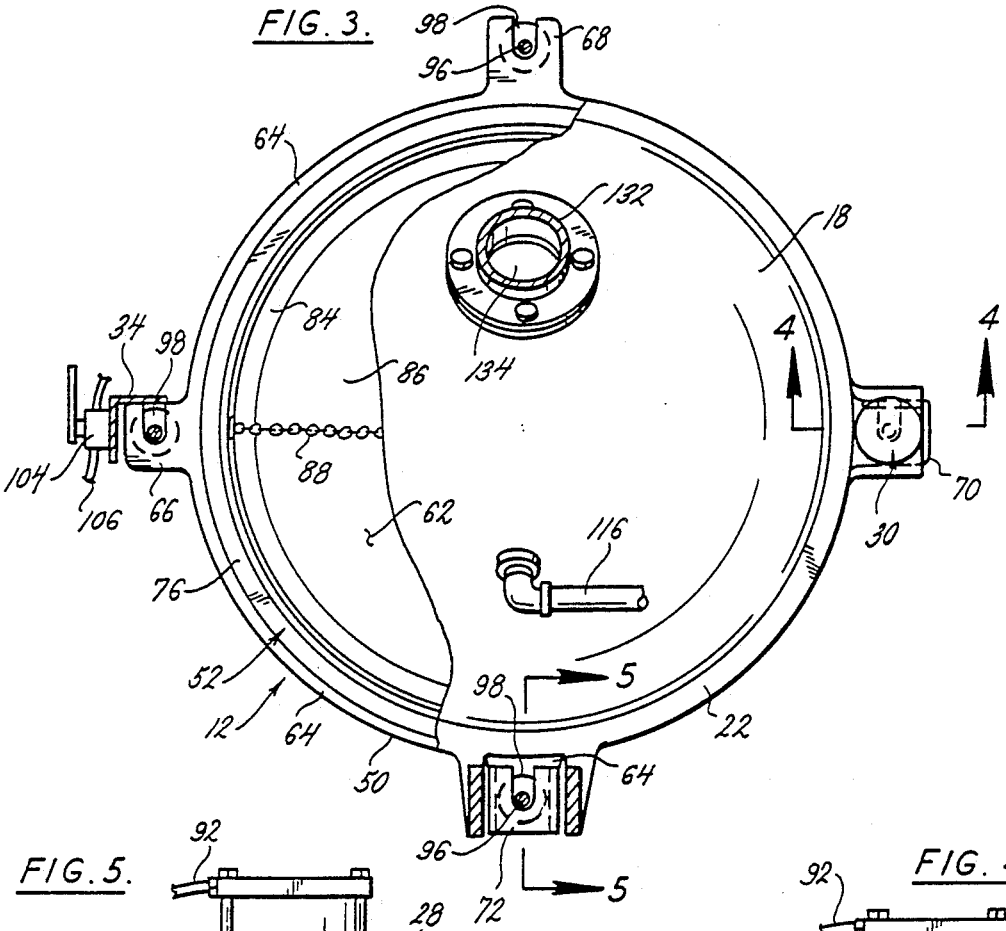
FIG. 5.
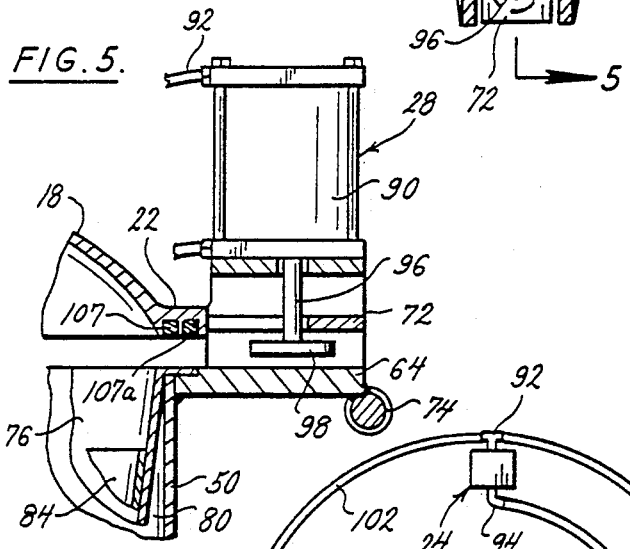
FIG. 4.
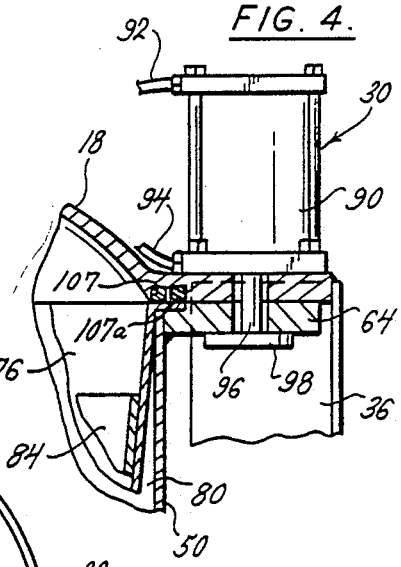
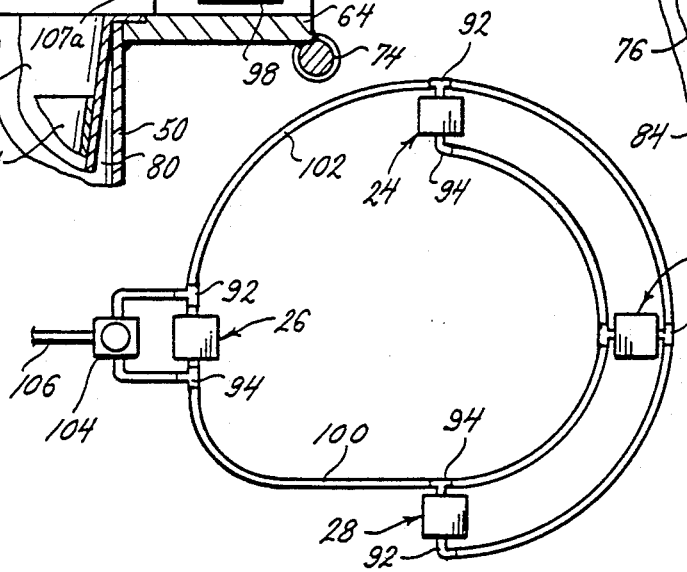
FIG. 6.

MICROWAVE SLUDGE DRYING APPARATUS AND METHOD

BACKGROUND OF THE INVENTION (1) Field of the Invention

The present invention relates to an apparatus and method for the efficient removal of hazardous volatile organic materials (HVOM) from waste sludge and liquid waste material. HVOM, hazardous volatile organic materials, are those volatile and semi-volatile organic materials which have hazardous waste characteristics of flammability, toxicity and/or carcinogenicity. In particular, the present invention pertains to an apparatus for receiving hazardous waste sludge on a batch basis and subjecting the sludge to microwave energy and conductive heat energy in a vacuum drying process, and to the method involved in using the subject apparatus to separate HVOM from the sludge by thermal desorption.

(2) Description of the Related Art

It is a common practice in industry to use significant amounts of solvents and other volatile organic matter in a variety of manufacturing process applications that often result in generating various different types of process waste by-products in the form of sludge, both hazardous and non-hazardous. These waste sludge by-products contain HVOM in a wide variety of solvent mixtures. Examples of these mixtures are found to contain paint pigments, resins, phenolics, photoresists, silica, metallic orides and other solid particulates and liquid contaminates. Waste sludge is produced in the aerospace, automotive, appliance, electronics, paint, coatings, film, textile, manufacturing and other related industries.

Industries that generate these solvent-laden solid waste by-products are finding it increasingly difficult to dispose of the hazardous waste sludge without the outlay of considerable expense. The indiscriminate dumping of hazardous waste, the increasing number of polluted landfills, the contamination of ground water, the potential for the release of toxic fumes from waste storage sites and the resulting air pollution, and the increased occurrences of employee injury resulting from the handling of waste sludge and the liability of the sludge producer despite their precautions, all add to the growing problem of the safe disposal of waste materials.

What is needed to resolve this problem is a waste by-product recovery system that substantially eliminates the HVOM content of waste by-products and hence eliminates the hazardous characteristics of flammability, toxicity and/or carcinogenicity of the waste, making it eligible for disposal in normal land fills not specifically designated for hazardous materials.

It is an object of the present invention to provide a volatile organic material (VOM) recovery system and a method of operating the system that substantially eliminates the HVOM from waste sludge, thereby delisting the sludge for disposal in readily available solid waste land fills, and concomitantly eliminating the high cost and producer liability associated with the disposal of waste byproducts.

It is, therefore, an object of the present invention to provide an apparatus and a method for separating hazardous volatile organic materials from industrial waste by-products, and substantially eliminate the HVOM content of the solvent-laden waste and delist the waste for disposal in readily available solid waste land fills.

SUMMARY OF THE INVENTION

The Microwave Sludge Drying Apparatus of the present invention is generally comprised of an evaporation/vacuum heating chamber, a microwave generator communicating with the chamber, an auxiliary heating source that heats the chamber by conduction, and a vacuum pressure system communicating with the chamber.

The evaporation/vacuum heating chamber is formed from a pair of separate, distinct segments. The chamber includes a stationary, elevated, chamber lid that forms the upper part of a hermetically sealed compartment contained within the evaporation chamber. The chamber also includes a lower vessel formed as a mobile cart that is separable and transportable independent of the elevated chamber lid, and is inserted beneath and connected to the elevated lid to form the hermetically sealed interior compartment of the evaporation/vacuum heating chamber. By separating the lower vessel from the elevated lid of the chamber, a top opening in the vessel is exposed. A vat for receiving HVOM on a batch basis is provided in the interior of the vessel. The vat is removably supported in the interior volume of the vessel, and is removable from the vessel by overhead mechanical means such as a hoist. By separating the vessel from its connection to the elevated lid, and transporting the vessel out from beneath the lid, a vat containing a batch of waste sludge to be dried may be inserted into the vessel prior to the vessel being reconnected with the lid or may be introduced through an access port in the lid and the drying of the sludge by the apparatus of the invention. The unique chamber provides safe containment for microwave treatment to protect the operator from exposure to microwave energy and incidental contact with hazardous waste materials.

The microwave generator provides microwave energy to the interior compartment of the chamber during the process of drying the HVOM sludge contained in the compartment. The microwave generator is located at a distance from the evaporation chamber to provide a safe environment in the area of the chamber when evaporating flammable solvents from a sludge batch. The microwave generator is connected to the chamber by a waveguide that leads from the generator to the elevated lid of the chamber and terminates at a microwave transmitting window in the lid. The window is formed from a material that is transparent to microwave energy, yet is strong enough to withstand the difference in force between the atmospheric pressure acting on the waveguide side of the window and the reduced pressure on the chamber compartment side of the window. The input of microwave energy into the chamber compartment is dependent upon the mass of the sludge contained in the vat of the compartment, the amount of liquid in the sludge, the dielectic constant, and the microwave dissipation characteristics of the solids of the sludge. The presence of moisture is a facilitating feature and assists in steam stripping HVOM from the solid waste. The addition of water to some applications effects a more efficient removal procedure. The microwave generator is provided with a system of controls to adjust the duration and intensity of the microwaves supplied to the chamber compartment based on these factors.

The vat and the evaporation/vacuum heating chamber, or at least the compartment interior surfaces of the chamber, are constructed of electrically conductive material such as stainless steel to resist corrosion associated with the treatment of HVOM in solid waste sludges. Because the intensity of the microwaves decreases within one wavelength of the metal surfaces of the vat and approaches zero at the metal surface of the vat, the microwaves will heat only the sludge contained in the interior volume of the vat and will not heat the sludge adjacent the surfaces of the vat. The auxiliary source of heating is needed to heat the sludge that is adjacent to the vat sidewalls and bottom. The auxiliary heating source is made a part of the transportable vessel of the evaporation chamber, and is preferably an electrical resistance type heat generator that surrounds the interior volume of the vessel. The auxiliary heating source heats by conduction the sidewall and bottom of the vat placed in the vessel interior. The heating of the vat by the auxiliary heating source provides the necessary heat transfer gradient between the metal surfaces of the vat and the portion of the sludge adjacent the vat surfaces that is not heated by the microwaves. This auxiliary conductive source may be steam or other methods of inducing thermal energy.

The vacuum pressure system is generally comprised of a vacuum pump and a condenser connected to the chamber lid by a series of conduits. The chamber compartment is evacuated by the vacuum pump, which evacuates both air and solvent vapors produced by heating the HVOM sludge from the chamber and provides an enclosed environment for the safe release and capture of flammable vapors. The vacuum pressure system also performs the secondary function of maintaining an equilibrium operation condition within the chamber compartment interior by withdrawing the solvent vapors from the chamber interior as they are produced, thereby maintaining a desired vacuum pressure in the compartment which is inert and incapable of supporting cumbustion, the particular pressure being dependent on the sludge composition. The preferred pressure ranges between 50 and 100 torr. The vacuum system allows the vapors to condense in the condenser, and removes the condensed solvent distillant from the condensor against atmospheric air pressure, thereby creating and preserving the reduced pressure of the container compartment interior. The distilled solvent and HVOM are collected in a tank for later disposal or reuse.

In this manner, the Microwave Sludge Drying Apparatus of the present invention reduces a batch of sludge to a dried cake of waste that may then be removed from the chamber compartment interior and disposed of in an approved solid waste land fill.

BRIEF DESCRIPTION OF THE DRAWINGS

Further objects and features of the present invention are revealed in the following detailed description of the preferred embodiment of the invention and in the drawing figures wherein:

FIG. 1 is a front elevation view of the Microwave Sludge Drying Apparatus of the present invention;

FIG. 2 is a side elevation view of the present invention taken along the line 2—2 of FIG. 1;

FIG. 3 is a plan view in section of the top of the microwave sludge drying apparatus of the present invention taken along the line 3—3 of FIG. 2;

FIG. 4 is an elevation view in section showing the details of the sludge drying apparatus of the present invention along the line 4—4 of FIG. 3;

FIG. 5 is an elevation view in section showing the details of the sludge drying apparatus of the present invention taken along the line 5—5 in FIG. 3; and FIG. 6 shows a schematic representation of a pneumatic circuit that operates a series of lift mechanisms that connect the first and second component parts of the microwave drying apparatus of the present invention.

DESCRIPTION OF THE PREFERRED EMBODIMENT

FIG. 1 shows the microwave sludge drying apparatus 10 of the present invention. The apparatus is generally comprised of an evaporation/vacuum heating chamber 12, a microwave generator 14, and a vacuum evacuation/condensing system 16.

The evaporation/vacuum heating chamber 12 is essentially composed of two primary components, a stationary elevated sealing lid 18 and a transportable vessel 20 that is separable from the lid. The lid 18 is dish shaped with a concave interior (not shown) and an annular rim 22 surrounding its periphery. Four pneumatically operated lift mechanisms 24, 26, 28, 30, are spacially arranged around the lid rim 22. The lift mechanisms are used to releasably attach the chamber vessel 20 to the lid 22 in a manner to be explained. A site glass 32 is also provided in the lid 22 to provide visual access to the interior of the compartment formed by the lid 18 and the attached chamber vessel 20. The lid is supported in its elevated stationary position by at least one pair of vertical support columns 34, 36 connected to the lid rim 22 at opposite ends of the lid. The vertical support columns 34, 36 are spaced apart a sufficient distance to permit the insertion of the transportable vessel 20 between the columns. The columns 34, 36 support the lid 18 above a base plate 38 of the apparatus, and straddle a pair of rails 40, 42 that support the transportable vessel 20 for movement in a manner to be described.

The transportable vessel 20 is formed in a general cylindrical configuration with a bottom wall 48, a sidewall 50, and a top opening 52. Four sets of roller wheels 54, 56, 58 (only three sets are shown) are provided on the bottom wall 48 of the vessel 20. The roller wheels engage with the pair of rails 40, 42 supported on the base plate 38, and permit the vessel 20 to be transported between a position underneath the elevated sealing lid 18 of the chamber, and a position out from beneath the sealing lid 18, exposing the interior volume 62 of the vessel through the top opening 52. The vessel includes an annular rim 64 around the periphery of its top opening 52. Four connector fork assemblies 66, 68, 70, 72 are spatially arranged around the vessel rim 64. The connector fork assemblies are adapted to releasably engage with the lift mechanisms 24–30 and releasably connect the transportable vessel 20 with the elevated sealing lid 18 in a manner to be described. A manual handle 74 is connected to the vessel rim 64 and facilitates the rolling of the vessel 20 into and out of the space beneath the elevated sealing lid 18 along the rails 40, 42. A jacket liner having a cylindrical sidewall 76 and a bottom 78 is provided in the vessel interior volume. The jacket liner is dimensioned slightly smaller than the dimensions of the vessel sidewall and bottom, and its position in the vessel interior forms an intermediate space 80 between the jacket liner and vessel interior that is filled with a heat conducting oil. An electrical resistance type heating system 82 is also provided in the intermediate space between the jacket liner and the interior of the vessel 20.

The heating system 82 is positioned adjacent to the bottom 48 and sidewall 50 of the vessel and completely surrounds the oil filled intermediate space 80 of the vessel.

A removable stainless steel vat having a cylindrical sidewall 84 and a bottom 86 is also inserted in the vessel interior 62. The vat nests snug within the jacket liner interior, with the vat sidewall 84 and bottom 86 engaging the sidewall 76 and bottom 78 of the liner respectively, forming a good heat conducting engagement between the vat and liner. The vat 84 is supported in the jacket liner interior in a manner that permits the vat to be lifted vertically out of the liner and removed from the vessel 20. The vat is open at its top and is provided with a chain handle 88 or other suspending assembly across its top opening to which a hoist mechanism may be connected to lift the vat, along with the sludge it contains, out of the vessel interior, or conversely, lowered into the vessel interior.

The vessel 20 is releasably connected to the underside of the lid 18 to form the sealed interior compartment of the chamber 12 by the four pneumatic lift mechanisms 24–30 spatially arranged around the lid rim 22. The structure of the individual lift mechanisms can best be seen in FIGS. 4 and 5. Each lift is constructed of a cylindrical housing 90 that contains a reciprocating piston (not shown). The piston is selectively moved up and down within the housing 90 by the alternate supply of pneumatic pressure to one of two pressure ports 92, 94 communicating with the cylinder interior, while draining pneumatic pressure from the other of the two ports. The two ports 92, 94 communicate with the cylinder interior on opposite sides of the piston. By supplying pneumatic pressure to the bottom port 94, and draining pneumatic pressure from the top port 92, the piston is raised in the cylinder 90. By supplying pneumatic pressure to the top port 92, and draining pneumatic pressure from the bottom port 94, the piston is lowered in the cylinder 90. A rod 96 connected to the lift piston extends through a seal (not shown) out of the bottom of each lift mechanism. The rods are dimensioned to enable the prongs of the connector fork assemblies 66–72 to engage around the rods when the pistons are lowered in their housings 90, and the vessel 20 is inserted beneath the lid 18. A land 98 is provided at the bottom end of each rod 96 to engage underneath the fork assemblies 66–72 as the vessel is positioned underneath the lid 18. The connector fork assembly 72 and the lift mechanism 28 positioned over the rails 40, 42 are slightly different from the others to enable the fork 72 to engage around the rod of the lift mechanism 28 as the vessel is rolled beneath the lid 18. As seen in FIG. 5, the fork 72 and the lift 28 are elevated so that the vessel 20 may roll past underneath the lift, and the fork prongs point forward to engage around the lift rod 96 as the vessel 20 is rolled beneath the lid 18.

The pneumatic pressure is supplied to and drained from the top and bottom ports of the lift mechanisms by the manually controlled fluid circuit shown in FIG. 6. The circuit includes a bottom conduit 100 that selectively supplies and drains pneumatic pressure to and from the bottom ports 94 of the lift mechanisms 24–30, and a top conduit 102 that selectively supplies and drains pneumatic pressure to and from the top ports 92 of the lift mechanisms. A manually operated valve 104 selectively supplies and drains pneumatic pressure to and from the two conduits 100, 102. When pressure is supplied to one conduit by the valve 104, the pressure is drained from the other conduit, and vice versa. The valve 104 is supplied with pneumatic pressure from a separate source of pressure (not shown) through the conduit 106. Manipulating the valve 104 to supply pneumatic pressure to the bottom conduit 100 and drain pressure from the top conduit 102 causes the pistons in each lift mechanism to lift the rods 96 and lands 98. The lands engage underneath the fork assemblies 66–72 of the vessel and lift the vessel, connecting the vessel in sealed engagement with the chamber lid 18 and forming the sealed compartment interior of the chamber. An O-ring 107*a* and microwave seal 107 around the lid rim 22 provides the sealing engagement between the lid 18 and vessel 20. Manipulating the valve 104 to supply pneumatic pressure to the top circuit 102 and drain pressure from the bottom circuit 100 causes the lift mechanisms to lower the rods 96 and lands 98, thereby lowering the vessel 20 back onto the rails 40, 42 where it can be rolled out from beneath the lid 18.

The evacuation/condensing system 16 is comprised of a counter flow heat exchanger 108, a condensate tank 110, and a vacuum pump 112 driven by an electric motor 114. A section of conduit 116 is connected between the chamber lid 18 and the heat exchanger 108 and communicates the interior volume of a compartment formed by the connected lid 18 and vessel 20 with the interior of the heat exchanger 108. Heat exchangers of the type employed in the present invention are known in the prior art and are generally comprised of a sealed housing with a coiled tube (not shown) extending through the length of the housing interior. The coiled tube communicates with a separate source of a liquid cooling medium (not shown) through an inlet port 118 and an outlet port 120 extending through the housing of the heat exchanger. The separate source of the liquid cooling medium pumps a cooling liquid such as water to the inlet port 118, through the coiled tube contained in the heat exchanger housing, and back out of the heat exchanger through the outlet port 102 where the cooling medium is returned to its source. Vapors that are produced in the chamber compartment interior and travel through the conduit 116 to the interior of the heat exchanger 108 housing condense on the surface of the cooling coil in the housing. An additional length of conduit 122 is connected to the heat exchanger 108 at the opposite end of the exchanger from its connection to the conduit 116 communicating with the chamber interior. The conduit 122 communicates the heat exchanger 108 with the condensate tank 110. The conduit 122 is connected to the top of the tank 110, and any solvent condensate that travels through the conduit 122 along with air evacuated from the chamber interior compartment will fall to the bottom of the tank 110 and collect there. An outlet valve 124 is provided at the bottom of the tank 110 to permit periodic draining of the solvent condensate from the tank. A further length of conduit 126 is connected between the top of the condensate tank 110 and the pump 112. The connection of this conduit 126 to the top of the condensate tank 110 permits the free flow of evacuated air between the conduits 122 and 126 without interference from the condensate collected in the bottom of the condensate tank 110.

The microwave generator 14 includes a microwave energy generating unit 130 and a waveguide 132 connecting the microwave generator 130 to the sealing lid 18 of the evaporation chamber 12. The microwave generating unit 130 is located remote from the evaporation chamber 12 and is preferably separated from the chamber 12 by a wall partition (not shown). This arrangement safely distances the source of microwave energy from the evaporation chamber when the chamber is used to distill flammable solvents from a sludge sample. The microwaves produced by the microwave generating unit 130 are conducted by the waveguide 132 through the elevated sealing lid 18 to the interior volume of the evaporation chamber 12. A window 134 is provided between the connection of the waveguide 132 to the elevated lid 18 of the evaporation chamber 12. The window is constructed from a material that is transparent to microwave energy and permits the microwaves conducted by the waveguide 132 to pass through and enter the interior of the evaporation chamber 12, yet the window is strong enough to withstand the force of atmospheric pressure on the waveguide side of the window and the reduced vacuum pressure on the chamber side of the window. The microwaves produced by the control unit 110 generally have a frequency of 915 MHz or 2,450 MHz, these being the frequencies allocated by the Federal Communications Commission for commercial microwave heating operations. The input of microwave energy into the chamber interior is dependent on the mass of the sludge contained in the vat, the amount of liquid in the sludge, the dielectric constant, and the microwave dissipation characteristics of the solids of the sludge. The microwave generating unit 130 is provided with a system of controls to adjust the duration and intensity of the microwaves supplied to the chamber compartment based on these factors. The field strength of the microwaves is maintained below the level at which ionization and glow discharge occurs, compensating for the reduced pressure of the evaporation chamber interior.

In use, the vessel 20 is uncoupled from the elevated lid 18 of the chamber 12 and rolled back from the lid along the rails 40, 42 to expose the interior volume of the vessel through the vessel top opening 52. A vat containing a sludge sample to be distilled and dried by the apparatus is then loaded into the vessel interior and is supported in the jacket liner of the vessel with the sidewall 84 and bottom 86 of the vat contacting the sidewall 76 and bottom 78 of the vessel liner in good heat conducting engagement. The vessel 20 with the inserted vat and sludge sample, is then wheeled forward along the rails 40, 42 to a position directly beneath the elevated lid 18 of the evaporation chamber 12. In this position of the vessel 20, the four connector fork assemblies 66, 68, 70, 72 each engage around the reciprocating rods 96 of their respective lift mechanisms 24, 26, 28, 30, above the lands 98 of the rods. A connector (not shown) is provided on the supporting structure of the sealing lid for automatically connecting the electrical resistance type heating system 82 of the vessel 20 to a separate source of electric energy as the vessel is positioned beneath the lid. The operator next manipulates the pneumatic pressure supply valve 104 to supply pneumatic pressure to the bottom port 4 of each of the lift mechanisms while draining their top ports 92, causing each mechanism to retract its rod 96 and connected land 98 and lift the entire transportable vessel 20 along with the inserted vat, joining the annular vessel rim 64 to the underside of the annular lid rim 22 and forming an air and microwave tight compartment in the interior of the evaporation chamber 12.

With the transportable vessel 20 connected to the elevated lid 18 of the chamber 12, the heating operation of the sludge contained in the vat is next commenced. The microwave energy generating unit 130, the conductive heating system 82, and the vacuum pump 94 are all simultaneously actuated. Within the vat, now sealed in the chamber 12, the pressure is reduced to between 50 and 100 torr and the sludge is subjected to microwaves conducted to the chamber interior by the waveguide 132, and conduction heating produced by the electrical resistance heating system 82. The microwaves conducted by the waveguide 132 pass through the window 134 and are reflected in the chamber compartment until they are absorbed in the sludge or attenuate. The heat produced by the resistance heating system 82 is conducted to the bottom and side surfaces of the vat by the heat conducting oil in the interior volume 80 of the vessel 20. The conductive heating of the vat heats the sludge in the area adjacent to the vat sidewalls and bottom where the microwave energy is reflected and at its lowest energy level, incapable of exciting the solvent molecules. The microwave and conduction heating excite the solvent molecules within the sludge, causing the volatile organic liquid within the sludge and the sludge itself to increase in temperature. The temperature continues to increase in the chamber interior until the solvents contained in the sludge are brought to their boiling point at the reduced operating pressure of the chamber interior and vaporize.

The solvent vapors created by subjecting the sludge to the microwave energy and conductive heat energy are withdrawn from the interior of the chamber by the evacuation/condensing system 16. The air and solvent vapor in the chamber interior are withdrawn through the conduit 116 into the counter flow heat exchanger 108 by the vacuum pump 112. In the heat exchanger 108, the solvent vapor condenses on the heat exchanger coil (not shown), through which a cooling medium is recirculated. The cooling medium is supplied from a separate source (not shown) through the inlet 118, and returns to the source through the outlet 100 of the coil. As the solvent vapor condenses, the vapor pressure reduces, creating a vacuum in the heat exchanger that becomes a motive force for removing solvent vapor from the chamber interior. The air evacuated from the chamber interior and the solvent condensate then flow through the conduit 122 to the condensate tank 110. The solvent condensate collects at the bottom of the tank 110, and the air extracted from the chamber interior passes through the tank 110, and out through the conduit 126 to the vacuum pump 112. The solvents distilled and collected in the condensate tank 110 may be withdrawn from the tank through the valve outlet 124 and reused if so desired. The process continues to subject the sludge to microwave and conduction heat energy, volatilizing the components of the sludge and inducing vaporizational stripping of the solvent from the sludge, leaving a resultant cake of sludge dry and virtually free of volatile matter. The dried sludge cake may then be removed from the vat and disposed of in a normal land fill.

While the present invention has been described by reference to a specific embodiment, it should be understood that modifications and variations of the invention may be constructed without departing from the scope of the invention defined in the following claims.

What is claimed is:

1. An apparatus for the separation of hazardous volatile organic materials (HVOM) from a sample of waste sludge by thermal desorption, the apparatus comprising:

a chamber means impervious to microwave, the chamber means containing a hollow compartment enclosing an interior volume adapted to contain the sludge sample;

a microwave generating means operatively connected to the chamber means to supply microwave energy to the chamber means and subject the sludge in the interior volume of the compartment to microwaves;

a pressure reducing means operatively connected to the chamber means to supply vacuum pressure to the chamber means and reduce the pressure of the interior volume of the compartment; and a heat generating means operatively connected to the chamber means, the heat generating means being adapted to supply heat to the compartment of the chamber means by conduction independent of microwaves generated by the microwave generating means.

2. The apparatus of claim 1 wherein:

the chamber means includes a first segment and a second segment, the first and second segments being movable relative to each other to open the compartment of the chamber means and provide access to the interior volume of the compartment.

3. The apparatus of claim 1, wherein:

the chamber means includes a first segment and a second segment, the first chamber segment being free standing and stationary and the second chamber segment being separable and transportable from the first chamber segment.

4. The apparatus of claim 3, wherein:

the first chamber segment is an elevated lid forming one half of the compartment, and the second chamber segment is a transportable vessel forming the second half of the compartment and having an opening at its top providing access to its interior, the vessel being separate from the lid and adapted to be inserted beneath the lid and coupled thereto to form the hollow compartment of the chamber means.

5. The apparatus of claim 4, wherein:

the heat generating means is mounted on the vessel and surrounds the interior of the vessel.

6. The apparatus of claim 4, wherein:

the second chamber segment includes a vat removably supported in the vessel interior and separable from the vessel.

7. The apparatus of claim 6, wherein:

the heat generating means is mounted on the vessel and surrounds the vat supported in the vessel interior to heat the vat by conduction.

8. The apparatus of claim 3, wherein:

the first chamber segment is an elevated lid and the second chamber segment is a transportable vessel separate from the lid and adapted to be inserted beneath the lid and coupled thereto to form the hollow compartment of the chamber means, and the microwave generating means includes a microwave generating source separate from the chamber means and a waveguide connected between the microwave source and the lid of the first chamber segment to conduct microwaves generated by the source to the lid and disperse the microwaves in the compartment of the chamber means.

9. The apparatus of claim 8, further comprising:

a microwave window in the lid between the connection between the lid and the waveguide, the window permitting the passage of the microwaves through the window while resisting the pressure of the compartment interior volume.

10. The apparatus of claim 3, wherein:

the first chamber segment is an elevated lid and the second chamber segment is a transportable vessel separate from the lid and adapted to be inserted beneath the lid and coupled thereto to form the hollow compartment of the chamber means; and the pressure reducing means includes a condenser, a vacuum pump, and a conduit connected between the lid of the first chamber segment and the condenser and vacuum pump to reduce the pressure in the compartment of the chamber means and to evacuate the interior volume of the compartment.

11. An apparatus for the separation of hazardous volatile organic materials from a solid waste by thermal desorption, the apparatus comprising:

a chamber means impervious to microwaves, the chamber means having first and second segments, the first chamber segment being stationary and the second chamber segment being transportable and separable from the first chamber segment, the first and second chamber segments being connectable to form a hermetically sealed compartment enclosing an interior volume of the chamber means;

a microwave generating means operatively communicating with the chamber means to subject the interior volume of the chamber means to microwaves; and a heat generating means operatively connected to the chamber means, the heat generating means being adapted to heat the compartment enclosing the interior volume of the chamber means independent of microwaves generated by the microwave generating means.

12. The apparatus of claim 11, wherein:

the first and second chamber segments are separable from each other to open the compartment of the chamber means and provide access to the interior volume of the compartment.

13. The apparatus of claim 11, wherein:

the first chamber segment is formed as an elevated lid constituting a first half of the compartment, and the second chamber segment is formed as a transportable vessel constituting a second half of the compartment.

14. The apparatus of claim 13, wherein:

the vessel of the second chamber segment is formed with an opening at its top providing access to its interior, the vessel being separate from the lid and adapted to be inserted beneath the lid and coupled thereto to form the compartment enclosing an interior volume.

15. The apparatus of claim 14, wherein:

the heat generating means is mounted on the vessel and surrounds the interior of the vessel.

16. The apparatus of claim 14, wherein:

the second chamber segment includes a vat removably supported in the vessel interior, the vat being separable from the vessel.

17. The apparatus of claim 14, wherein:

the heating generating means is mounted on the vessel and surrounds the vat supported in the vessel interior to heat the vat by conduction.

18. The apparatus of claim 11, wherein:

the microwave generating means includes a microwave generating source separate from the chamber means, and a waveguide connected between the microwave source and the first chamber segment of the chamber means to conduct microwaves generated by the source to the first chamber segment and disperse the microwaves in the compartment of the chamber means.

19. The apparatus of claim 11, further comprising:

a pressure reducing means operatively connected to the chamber means to supply vacuum pressure to the chamber means and to evacuate the interior volume of the compartment and reduce the pressure in the compartment interior volume.

20. The apparatus of claim 19, wherein:

the pressure reducing means including a condenser and a vacuum pump, and a conduit connecting the first chamber segment to the condenser and vacuum pump to evacuate the interior volume of the compartment and reduce the pressure of the compartment interior.

21. A method of separating hazardous volatile organic materials from a solid waste by thermal desorption, the method including:

providing a chamber means impervious to microwaves and having an enclosable interior volume, and enclosing the solid waste in the interior volume of the chamber means;

providing a means of generating microwave energy and of directing microwaves generated into the enclosed interior of the chamber means, and heating the solid waste by subjecting it to the microwaves generated;

providing a means of heating the chamber means interior by conduction independent of microwaves generated by the microwave generating means, and heating the chamber means interior and the solid waste enclosed therein by conductive heating; and providing a means of evacuating and reducing the pressure of the chamber means interior, and evacuating and reducing the pressure of the chamber means interior to remove hazardous volatile organic materials that separate from the solid waste by thermal desorption as the solid waste is heated in the chamber means interior.

* * * * *